US006496115B2

(12) United States Patent
Arakawa

(10) Patent No.: US 6,496,115 B2
(45) Date of Patent: Dec. 17, 2002

(54) SYSTEM AND METHOD FOR ANALYZING BABY CRIES

(75) Inventor: Kaoru Arakawa, Kawasaki (JP)

(73) Assignee: Meiji University Legal Person, Tokyo (JP)

( * ) Notice: Subject to any disclaimer, the term of this patent is extended or adjusted under 35 U.S.C. 154(b) by 0 days.

(21) Appl. No.: 09/963,543

(22) Filed: Sep. 27, 2001

(65) Prior Publication Data

US 2002/0135485 A1 Sep. 26, 2002

(30) Foreign Application Priority Data

Mar. 22, 2001 (JP) ..... 2001-083121

(51) Int. Cl.[7] ..... G08B 23/00

(52) U.S. Cl. ..... 340/573.1; 367/197; 367/198; 367/199; 381/56; 381/57; 381/58; 704/246

(58) Field of Search ..... 340/573.1, 573.2, 340/573.3, 573.4, 566; 367/197, 198, 199; 381/56, 57, 58; 704/246, 270

(56) References Cited

U.S. PATENT DOCUMENTS 5,452,274 A * 9/1995 Thompson ..... 367/197
5,668,780 A * 9/1997 Hsieh ..... 367/198
6,084,527 A * 7/2000 Spector ..... 340/825.06
6,292,776 B1 9/2001 Chengalvarayan ..... 704/219

FOREIGN PATENT DOCUMENTS

JP A 2000-245718 9/2000

OTHER PUBLICATIONS

Sonoko Asayama et al., "A method of classifying baby cries by frequency analyses", Proceedings of the 2000 Information and Systems Society Conference of Ieice, p. 279, Sep./Oct. 2000.

* cited by examiner

*Primary Examiner*—Jeffery Hofsass
*Assistant Examiner*—Davetta W. Goins
(74) *Attorney, Agent, or Firm*—Oliff & Berridge, PLC

(57) ABSTRACT

This invention provides a system for analyzing baby cries capable of diagnosing a cause of cry of a baby based on a cry from the baby. A microphone (1) picks up a cry from a baby as an audio signal. At a certain sampling frequency, an A/D converter (2) samples the audio signal received by the microphone (1) to A/D convert it. An audio analyzer (3) analyzes the audio signal samples by the A/D converter (2) and computes a characteristic quantity based on a frequency spectrum. A cause-of-cry assumption unit (4) assumes a cause of cry based on the characteristic quantity of the audio signal derived at the audio analyzer (3). Finally, an assumed result display (5) displays the assumed result from the cause-of-cry assumption unit (4).

6 Claims, 3 Drawing Sheets

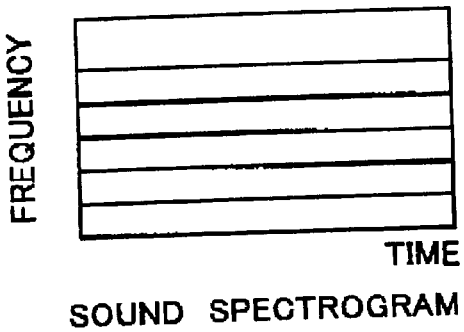
FIG. 4A1
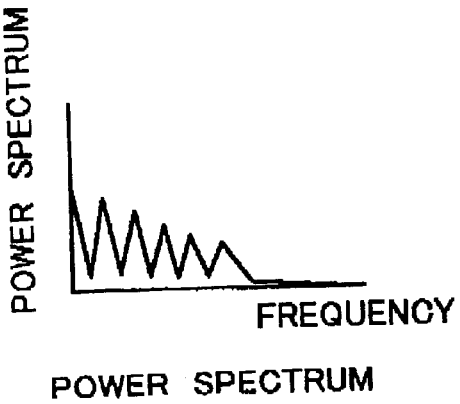
FIG. 4A2
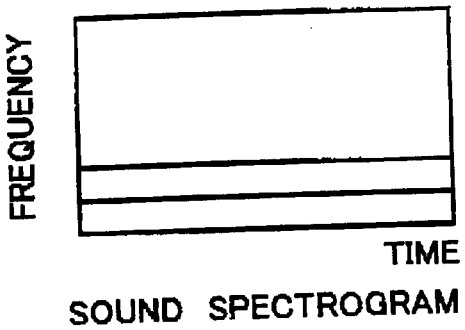
FIG. 4B1
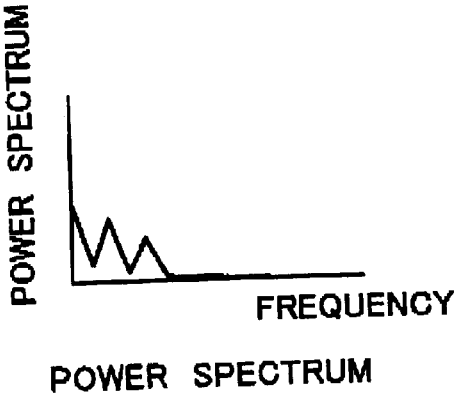
FIG. 4B2
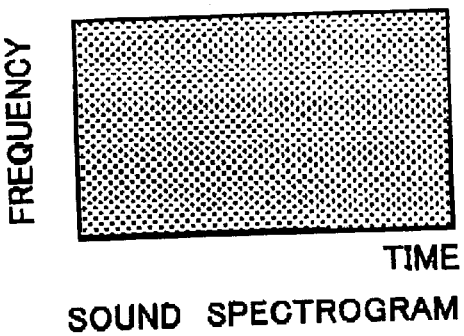
FIG. 4C1
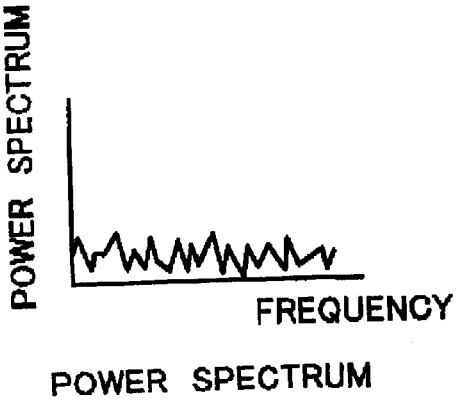
FIG. 4C2

SYSTEM AND METHOD FOR ANALYZING BABY CRIES

CROSS REFERENCE TO RELATED APPLICATION

This application claims benefit of priority under 35 USC §119 to Japanese Patent Application No. 2001-83121, filed on Mar. 22, 2001, the entire contents of which are incorporated by reference herein.

BACKGROUND OF THE INVENTION

1. Field of the Invention

The present invention relates to a system and method for analyzing baby cries to assume and display a psychological condition of a baby.

2. Description of the Related Art

A baby has no words but can pronounce a voice to express some psychological condition. For example, the baby laughs when it is in a good humor and cries when it has some uncomfortable feeling. The baby intends to appeal some inconvenience with a cry and cries when it feels uncomfortable. Persons involved in baby rearing, such as the mother and a nurse, try to diagnose the cause and eliminate the inconvenience. It is often difficult, however, to diagnose the cause of the uncomfortable feeling from the cry of the baby. As a result, the nurse tends to suffer from rearing stresses.

SUMMARY OF THE INVENTION

The present invention has been made in consideration of such the situations and accordingly has an object to provide a system for analyzing baby cries capable of diagnosing a cause of cry of a baby based on a cry from the baby.

The present invention provides a system for analyzing baby cries, which comprises audio analysis means for receiving an audio signal of a baby, performing waveform analysis (such as a frequency analysis, and an envelope shape analysis of a waveform) to the audio signal and computing a characteristic quantity based on a result (such as a frequency spectrum and an envelope shape) from the waveform analysis of the audio signal; cause-of-cry assumption means for assuming a cause of cry of the baby based on the characteristic quantity computed at the audio-analysis means; and display means for displaying the cause of cry assumed by the cause-of-cry assumption means.

The inventor performed frequency analysis to audio signals collected from a crying baby when it is painful (immediately after an injection), hungry (before feeding milk or baby food) and sleepy (after a meal before getting to sleep). As a result, it was confirmed that waveforms of the audio signals, such as characteristic quantities based on frequency spectrums, have different patterns respectively in the times of pain, hunger and sleep. The present invention stands on this foot.

According to the present invention, an audio signal of a crying baby is subjected to waveform analysis to assume a cause of cry of the baby from the characteristic quantity based on the result of the waveform analysis and the assumed result is displayed. Therefore, the cause of cry of the baby can be precisely indicated to a nurse who rears the baby, thereby aiding the nurse to reduce a rearing load.

If the result of the waveform analysis is a frequency spectrum, the characteristic quantity based on the frequency spectrum may employ, after clipping one breath-length of audio signal from the audio signal of the baby, at least one of: N frequency spectrums computed for each of N different small zones on the clipped one breath-length of audio signal (N denotes an arbitrary natural number); distributed values at respective frequency bands; cepstrums with respect to the frequency spectrums; and periodic peak positions in the frequency spectrums.

The cause-of-cry assumption means may assume the cause of cry based on the presence/absence of periodicity in each band in the frequency spectrum of the audio signal and a frequency band with periodicity. Specifically, the cause-of-cry assumption means may assume the cause of cry as: "hungry" when the frequency spectrum of the audio signal has periodicity continuously from a low frequency band to a high frequency band; "sleepy" when the frequency spectrum of the audio signal has periodicity continuously within a low frequency band; and "painful" when the frequency spectrum of the audio signal has no periodicity or a period thereof varies in time.

The present invention also provides a method of analyzing baby cries, which comprises receiving an audio signal of a baby; performing waveform analysis to the audio signal and computing a characteristic quantity based on a result from the waveform analysis of the audio signal; and assuming a cause of cry of the baby based on the computed characteristic quantity.

Other features and advantages of the invention will be apparent from the following description of the preferred embodiments thereof.

BRIEF DESCRIPTION OF THE DRAWINGS

The present invention will be more fully understood from the following detailed description with reference to the accompanying drawings in which:

FIGS. 4A1, 4B1 and 4C1 are graphs showing sound spectrograms on different causes of cries observed in the same system;

FIGS. 4A2, 4B2 and 4C2 are graphs showing power spectrums on different causes of cries observed in the same system.

DETAILED DESCRIPTION OF THE PREFERRED EMBODIMENTS

Figure 1:
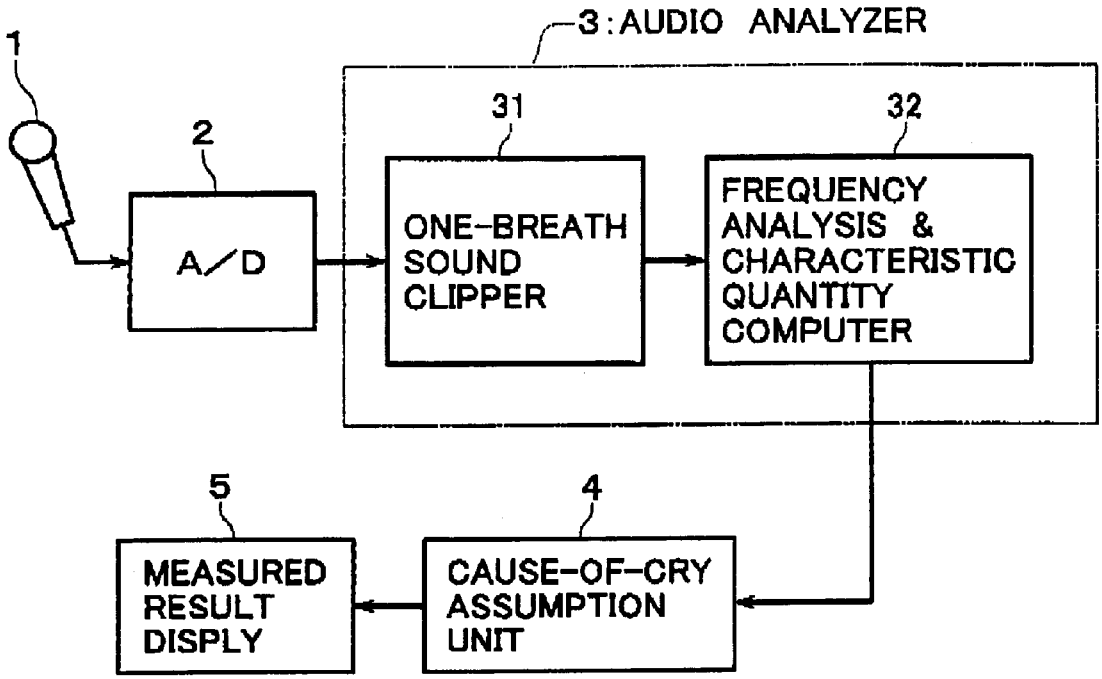
FIG. 1 is a block diagram of a system for analyzing baby cries according to an embodiment of the present invention.

Referring now to the drawings, embodiments of the present invention will be described below. FIG. 1 is a functional block diagram showing an arrangement of a system for analyzing baby cries according to an embodiment of the present invention.

In this system, a microphone 1 picks up a cry from a baby as an audio signal. At a certain sampling frequency, an A/D converter 2 samples the audio signal received by the microphone 1 to analog-to-digital convert it. An audio analyzer 3 analyzes the audio signal sampled by the A/D converter 2 and computes a characteristic quantity based on a frequency spectrum. A cause-of-cry assumption unit 4 assumes a cause of cry based on the characteristic quantity of the audio signal derived at the audio analyzer 3. Finally, an assumed result display 5 displays the assumed result from the cause-of-cry assumption unit 4.

This system can be realized from one or both of hardware and software in various forms corresponding to installation locations of the system. For example, the following forms can be considered as non-limiting examples. (1) In one form, the microphone 1 is installed near the baby to collect a voice therefrom and send its audio signal to the remotely located audio analyzer 3, cause-of-cry assumption unit 4 and assumed result display 5 via wire or radio to analyze, assume and display. (2) In another form, the entire system is installed near the baby. (3) In a further form, collection, analysis and assumption of the audio signal are performed near the baby and the assumed result is displayed on the assumed result display 5 remotely located.

The following example shows a specified analysis and assumption method that classifies conditions in three types of hunger, sleep and pain using frequency analysis.

First, a cry from a baby is picked up by the microphone 1 and digitized at the A/D converter 2. A sampling frequency used at this time is desirably set as high as 30 kHz or more, preferably 40 kHz or more (for example, 44.1 kHz) to observe frequency components at 15 kHz or more and prevent folded noises from mixing.

Figure 2:
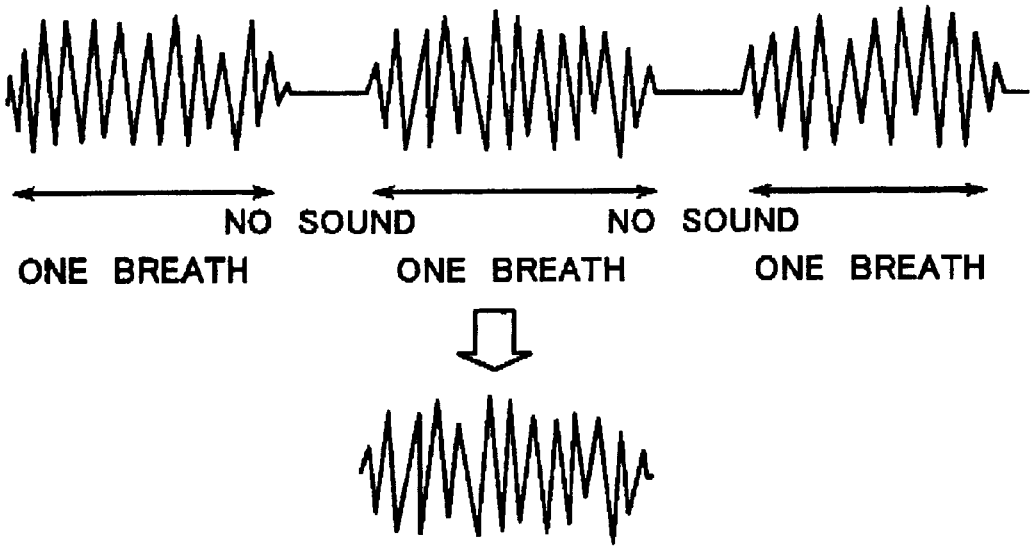
FIG. 2 is a waveform diagram showing an audio signal input to the same system when a baby cries and a method of clipping the signal.

The obtained digital data is supplied to the audio analyzer 3. The audio analyzer 3, along with the cause-of-cry assumption unit 4, can be configured from a signal-processing device such as a personal computer, a microprocessor and a DSP. The audio analyzer 3 includes a one-breath sound clipper 31 and a frequency analysis & characteristic quantity computer 32 as its functions. First, one breath-length of audio signal is clipped out. A baby generates cries intermittently in response to its breaths as shown in FIG. 2. The audio signal repeatedly includes a sound part of one breath-length and a non-sound part. The one-breath sound clipper 31 clips one breath-length of audio signal out of each zone that has some extent of continuous sound pressure level.

Figure 3:
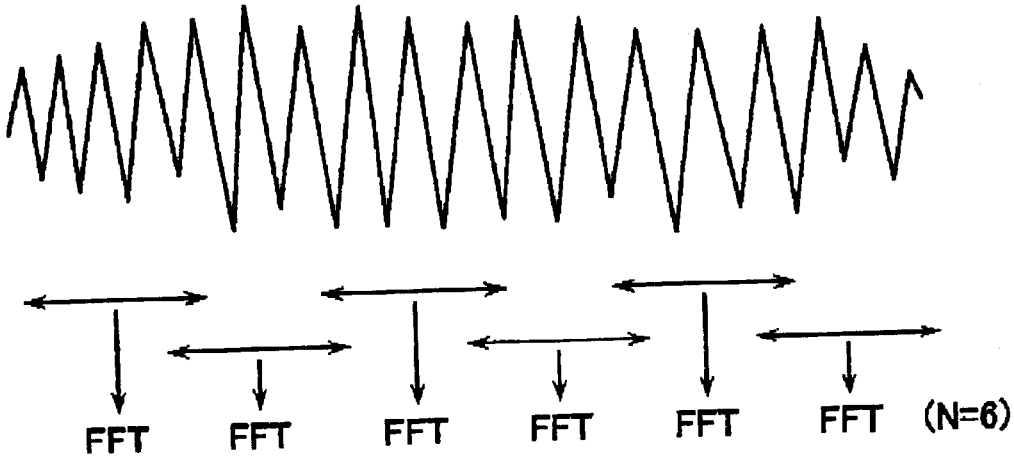
FIG. 3 explains successive FFTs in the same system.

Next, the frequency analysis & characteristic quantity computer 32 takes N small zones at a certain interval out of the audio signal in the clipped region as shown in FIG. 3. For these small zones, the computer 32 performs Fourier transform to derive a frequency spectrum (power spectrum) per small zone and compute its characteristic quantity. A general type of Fourier transform is FFT (Fast Fourier Transform), which is employed for the following description, though other types may also be employed, needless to say.

FIGS. 4A2, 4B2 and 4C2 are graphs showing frequency spectrums (power spectrums) at respective time points (N points) while FIGS. 4A1, 4B1 and 4C1 are graphs showing sound spectrograms with the transversal axis of time and the vertical axis of frequency based on the power spectrums that are continuously derived.

The cause of cry of the baby includes being hungry, sleepy, painful, lonely, terrible and uncomfortable. Among those, with respect to being hungry, sleepy and painful (when it feels extremely painful suffering from an injection and the like), sound spectrograms of cries are observed as follows:

(1) When the baby is hungry: A cry of one breath region is clipped out to obtain frequency spectrums respectively for N small zones in the clipped region. The obtained N frequency spectrums (power spectrums) comprise substantially identical periodic waveforms that have peaks periodically appeared from a low frequency (0 kHz) to a high frequency (approximately 10 kHz or more) as shown in FIGS. 4A1 and 4A2. Therefore, when a sound spectrogram is obtained for the cry of one breath, it is found that lateral stripes appear continuously from a low frequency (0 kHz) to a high frequency (approximately 10 kHz or more).

(2) When it is sleepy: A cry of one breath region is clipped out to obtain frequency spectrums respectively for N small zones in the clipped region. The obtained N frequency spectrums (power spectrums) comprise substantially identical periodic waveforms that have peaks periodically appeared only within a low frequency band (0–6 kHz) as shown in FIGS. 4B1 and 4B2. Therefore, in a sound spectrogram for the cry of one breath, it is found that lateral stripes appear only within a low frequency band (0–6 kHz).

(3) When it is painful: A cry of one breath region is clipped out to obtain frequency spectrums respectively for N small zones in the clipped region. The obtained N frequency spectrums (power spectrums) comprise totally irregular waveforms that have no periodic waveforms appeared as shown in FIGS. 4C1 and 4C2. Therefore, in a sound spectrogram for the cry of one breath, it is found that strong components appear from a low frequency band to a high frequency band but they are not clear lateral strips. Rather, they may be random patterns or wound stripes. In the case of the wound stripes, periodic waveforms appear but their periods greatly vary from point to point. In this case, the cry can be heard as a sound of scream.

In consideration of the above, the frequency analysis & characteristic quantity computer 32 computes characteristic quantities, which includes:

a) N power spectrums obtained from FFT for N points;

b) Distributed values within each frequency band in N power spectrums;

c) Cepstrums obtained per respective frequency bands in each power spectrum; and d) Locations of peaks for those with periodicity detected in power spectrums.

Next, the cause-of-cry assumption unit 4 assumes the cause of cry of the baby from the characteristic quantities computed at the frequency analysis & characteristic quantity computer 32. Specifically, it establishes rules for the three types of being painful, hungry and sleepy in consideration of the above differences in the characteristics and assumes the cause-of-cry based on the rules. For example, the following method can be considered. First, the unit 4 obtains N power spectrums in a cry of each one breath. In this case, the following rules are applied.

a) The unit 4 assumes "painful" if the following power spectrums are present as many as M0 or more ($N \geqq M0$).

In a high frequency band (A kHz or more), a distribution of the power spectrums exceeds a certain threshold value T0 and a periodicity can not be detected in the whole frequency band or can be detected with peak locations greatly varying from spectrum to spectrum, M0 is set 60% of N and A 15 approximately.

b) It assumes "hungry" in any one of the following cases.

i) A periodicity is detected at least one location at B kHz or above.

ii) An obvious periodicity is detected at C kHz or above and a periodicity is detected at D–E kHz in power spectrums of M1 or more. C is equal to 11, D 6, E about 10 and M1 about N/2.

iii) A periodicity is slightly detected at C' kHz or above and the distribution of the power spectrum is almost constant before and behind D' kHz. C' is substantially equal to that of the C in the case of ii).

c) It assumes "sleepy" in other cases.

Figure 5A:
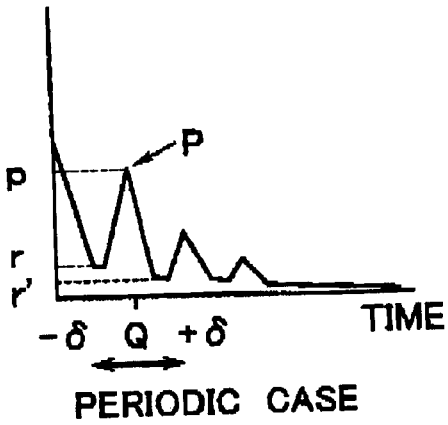
FIGS. 5A and 5B are graphs showing cepstrums observed in the same system.
Figure 5B:
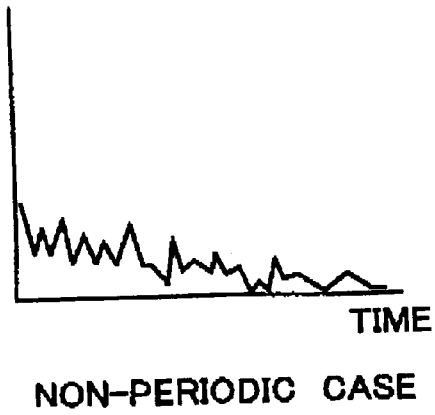

In the above processing, a periodicity can be detected in the following manner. A cepstrum is determined in the designated frequency band and is shown as FIG. 5A when a periodicity is present and FIG. 5B when no periodicity is present. A location of a first peak P in FIG. 5A corresponds to the periodicity. As the location of P appearing on the transversal axis can be assumed generally, a maximum value can be derived within such a range. When Q denotes its location on the transversal axis, minimum values r, r' of cepstrums before and behind ±δ from Q can be derived (δ is equal to about Q/2). When p denotes a cepstrum value at P, if finite differences between p and r, r', |p−r| and |p−r'|, both exceed a certain threshold T1, it can be determined that a periodicity is present.

The cause of cry is not limited to one but may be composite. For example, when the baby is hungry and sleepy, it is found in the sound spectrum that lateral stripes appear partly up to a high frequency band but partly only at a low frequency band. In consideration of such the ambiguous cases, it is also possible to provisionally assume a possibility of the cause by the number of power spectrums or clearness of stripes that satisfy the above rules. For example, in the case of ii) of the above rule b), if the number of the power spectrums with stripes detected at D–E kHz is equal to 80% M1, it can be assumed that the baby is "hungry with 80% possibility" or "probably hungry". If the values of |p−r| and |p−r'| in the periodicity detection are slightly less than T1, it should not be concluded as "the periodicity is not present" but determined to assume "being probably sleepy" because "probably the periodicity is not present".

The cries of the baby continue intermittently together with its breaths. The above matters are analysises for the cries split per breath. Actually, in a series of cries, one with a different assumed result may mix into others due to a determination error. In such the case, it can be considered, after observing several assumed results before and after it, to determine the largest one as a final assumed result. For example, when the assumed results per breath successively indicate "hungry", "hungry", "sleepy" and "hungry", it can be determined "hungry".

The measured result display 5 displays these assumed results with characters, images, lights, voices and so forth. As a result, it is possible to notice both the fact and cause of the cry to the nurse in charge of rearing the baby, who monitors the display 5 at a location apart from the baby, thereby performing extremely effective aiding of the baby rearing.

In the above embodiment, the frequency analysis is employed as the waveform analysis of the audio signal and the frequency spectrum as the waveform analyzed result, though characteristic quantities by other waveform analysis on the time axis may also be employed. For example, the envelope of the audio signal corresponding to one cry becomes a smooth shape when the baby feels hungry or sleepy and cries naturally. The envelope of the audio signal, however, becomes a disturbed shape when the baby feels painful. Therefore, the analysis of the envelope shape of the audio signal is employed as the waveform analysis to capture a characteristic from the analyzed result and assume the cause of cry.

As obvious from the forgoing, according to the present invention, an audio signal of a crying baby is subjected to waveform analysis to assume a cause of cry of the baby from the characteristic quantity based on the result of the waveform analysis and the assumed result is displayed. Therefore, the cause of cry of the baby can be precisely indicated to a nurse who rears the baby, thereby effectively aiding the nurse to reduce a rearing load.

Having described the embodiment consistent with the invention, other embodiments and variations consistent with the invention will be apparent to those skilled in the art. Therefore, the invention should not be viewed as limited to the disclosed embodiment but rather should be viewed as limited only by the spirit and scope of the appended claims.

What is claimed is:

1. A system for analyzing baby cries, comprising:

audio analysis means for receiving an audio signal of a baby, performing waveform analysis to said audio signal and computing a characteristic quantity based on a result from said waveform analysis of said audio signal;

cause-of-cry assumption means for assuming a cause of cry of said baby based on said characteristic quantity computed at said audio-analysis means; and display means for displaying said cause of cry assumed by said cause-of-cry assumption means.

2. The system for analyzing baby cries according to claim 1, wherein said audio analysis means performs frequency analysis to said audio signal of said baby and computing said characteristic quantity based on a frequency spectrum of said audio signal.

3. The system for analyzing baby cries according to claim 2, said audio analysis means including:

means for clipping one breath-length of audio signal from said audio signal of said baby; and frequency analysis and characteristic quantity computing means for computing a frequency spectrum for each of N different small zones (N denotes an arbitrary natural number) on said clipped one breath-length of audio signal, and computing as characteristic quantities at least one of computed N frequency spectrums, distributed values at respective frequency bands, cepstrums for said frequency spectrums and periodic peak positions in said frequency spectrums.

4. The system for analyzing baby cries according to claim 2, wherein said cause-of-cry assumption means assumes said cause of cry based on the presence/absence of periodicity in each band in said frequency spectrum of said audio signal and a frequency band with periodicity.

5. The system for analyzing baby cries according to claim 2, wherein said cause-of-cry assumption means assumes said cause of cry as: "hungry" when said frequency spectrum of said audio signal has periodicity continuously from a low frequency band to a high frequency band; "sleepy" when said frequency spectrum of said audio signal has periodicity continuously within a low frequency band; and "painful" when said frequency spectrum of said audio signal has no periodicity or a period thereof varies in time.

6. A method of analyzing baby cries, comprising:

receiving an audio signal of a baby;

performing waveform analysis to said audio signal and computing a characteristic quantity based on a result from said waveform analysis of said audio signal; and assuming a cause of cry of said baby based on said computed characteristic quantity.

* * * * *